US008888605B2

(12) United States Patent
Cynn

(10) Patent No.: US 8,888,605 B2
(45) **Date of Patent: *Nov. 18, 2014**

(54) GOLF PUTTER

(71) Applicant: Kie-Ho Cynn, Kapolei, HI (US)

(72) Inventor: Kie-Ho Cynn, Kapolei, HI (US)

( * ) Notice: Subject to any disclaimer, the term of this patent is extended or adjusted under 35 U.S.C. 154(b) by 123 days.

This patent is subject to a terminal disclaimer.

(21) Appl. No.: 13/573,490

(22) Filed: Sep. 17, 2012

(65) Prior Publication Data

US 2014/0080618 A1 Mar. 20, 2014

(51) Int. Cl.
*A63B 69/36* (2006.01)
*A63B 53/04* (2006.01)

(52) U.S. Cl.
USPC ..... 473/249; 473/250; 473/251; 473/340; 473/349

(58) Field of Classification Search
CPC ..... A63B 53/007; A63B 53/0487; A63B 53/065; A63B 2053/0441
USPC ..... 473/340, 341, 249–256, 286; D21/736–746, 759
See application file for complete search history.

(56) References Cited

U.S. PATENT DOCUMENTS

| | | | | |
|---|---|---|---|---|
| 1,960,110 | A * | 5/1934 | Iles | 473/286 |
| 3,134,596 | A | 5/1964 | Boznos | |
| 3,211,455 | A | 10/1965 | Hyden | |
| 3,708,172 | A * | 1/1973 | Rango | 473/249 |
| 3,815,910 | A | 6/1974 | Raines | |
| 4,934,702 | A * | 6/1990 | Serizawa | 473/251 |
| 4,960,279 | A | 10/1990 | Harris, Jr. | |
| 4,962,931 | A | 10/1990 | Jazdzyk, Jr. | |
| 5,282,625 | A | 2/1994 | Schmidt et al. | |
| 5,342,812 | A | 8/1994 | Niskanen et al. | |
| 5,605,510 | A | 2/1997 | Schmidt et al. | |
| 5,630,765 | A * | 5/1997 | Moore | 473/252 |
| 5,725,441 | A * | 3/1998 | Jensen et al. | 473/251 |
| 6,319,146 | B1 | 11/2001 | Mills | |
| 6,569,032 | B1 | 5/2003 | Haliyo | |
| 7,022,030 | B2 | 4/2006 | Best et al. | |
| 7,351,162 | B2 | 4/2008 | Soracco et al. | |
| 7,377,860 | B2 | 5/2008 | Breier et al. | |
| 7,384,345 | B2 * | 6/2008 | Sherman | 473/249 |
| 7,524,249 | B2 | 4/2009 | Breier et al. | |
| 7,578,752 | B1 * | 8/2009 | Flores | 473/330 |
| 7,588,499 | B2 | 9/2009 | Tateno | |
| 7,645,199 | B2 | 1/2010 | Cameron | |
| 7,658,686 | B2 | 2/2010 | Soracco | |
| 7,857,710 | B2 | 12/2010 | Pedraza | |
| D697,567 | S * | 1/2014 | Cynn | D21/742 |
| 2002/0193184 | A1 | 12/2002 | Currie et al. | |
| 2003/0092503 | A1 | 5/2003 | Snowden | |
| 2005/0197205 | A1 * | 9/2005 | Hale, Jr. | 473/340 |
| 2006/0063607 | A1 * | 3/2006 | Crossley | 473/340 |
| 2008/0009367 | A1 * | 1/2008 | Johnson | 473/341 |
| 2009/0017934 | A1 | 1/2009 | Stites et al. | |
| 2010/0227704 | A1 * | 9/2010 | Souza et al. | 473/340 |
| 2012/0184393 | A1 | 7/2012 | Franklin | |

FOREIGN PATENT DOCUMENTS

| | | |
|---|---|---|
| GB | 2335149 | 9/1999 |

* cited by examiner

*Primary Examiner* — Sebastiano Passaniti

(57) ABSTRACT

The present invention relates to an improved golf putter head with a unique shape and. sighting and alignment system. The head has an annular-like body with an undulating rim edge. A transparent plate extends across the opening of the annular body bearing the alignment aid. The alignment aid may have a crosshair component. The surface of the annular body is provided with a camouflage pattern.

17 Claims, 5 Drawing Sheets

GOLF PUTTER

FIELD OF THE INVENTION

The invention relates to a putter that minimizes visual errors and distractions and greatly enhances the visual impact and highlighting the alignment aid leading to faster alignment of the putter.

BACKGROUND OF THE INVENTION

Golf is both a physical and psychological endeavor. Many attempts have been made in designing a putter that minimize visual errors that plague putting by the golfer and improve player confidence in this aspect of golfing. Improved visual and faster acquisition of proper sighting and alignment of the putter have been elusive goals of these attempts.

Visual distraction, which arises from the physical appearance of the putter head, affects the accuracy of the stroke during the act of putting. Efforts to minimize this source of distraction on such factors as shape and/or texture and/or color or color pattern of the top surface of the putter head itself in order to highlight the alignment aid or indicia on the putter head. One solution was proposed in U.S. Pat. No. 4,962,931 (Jazdzyk). This solution involved providing the upper surface of putter head with a camouflaging texture simulating the color and texture of grass covering the putting green. Jazdzyk's camouflaging pattern on the putter head according to Jazdzyk, rendered "the shape of the club head in some degree indistinguishable from the green as observed by a putting golfer and because of the camouflaging effect of the upper surface contrasting and readily observable indicia on the club head is more effective for addressing a golf ball and squaring the putter head with the intended line of putt and stroking of the club head for putting the ball along the intended line on the green." More recent attempts at using color pattern or camouflaging pattern the putter head may be found in the disclosures of GB 2335149A and U.S. Pat. No. 7,022,030.

BRIEF SUMMARY OF THE INVENTION

The present invention improves and solves the problem of visual distraction caused by the visual appearance of the putter head and allows the golfer to very quickly see only the alignment aid of the putter aid. The present inventive combination of camouflage, transparency and alignment aid design of the putter head produces synergistic instant visual impact and acquisition, and putter alignment that increases accuracy. Not only the mechanical or physical aspect of putting improved, golfer confidence in his or her putting is also thereby reinforced.

DETAIL DESCRIPTION OF THE INVENTION

Figure 1:
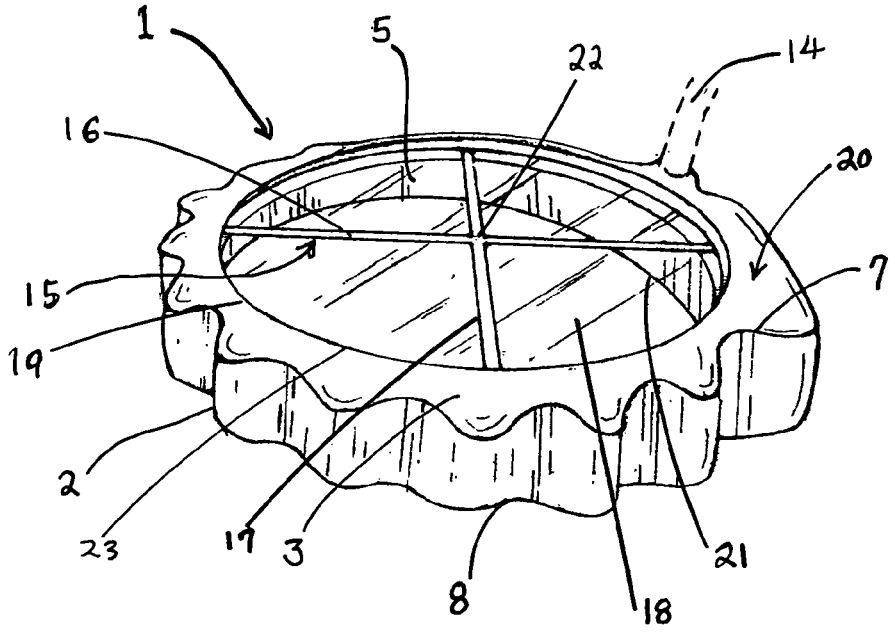
FIG. 1 is a top perspective view of the inventive putter head.
Figure 2:
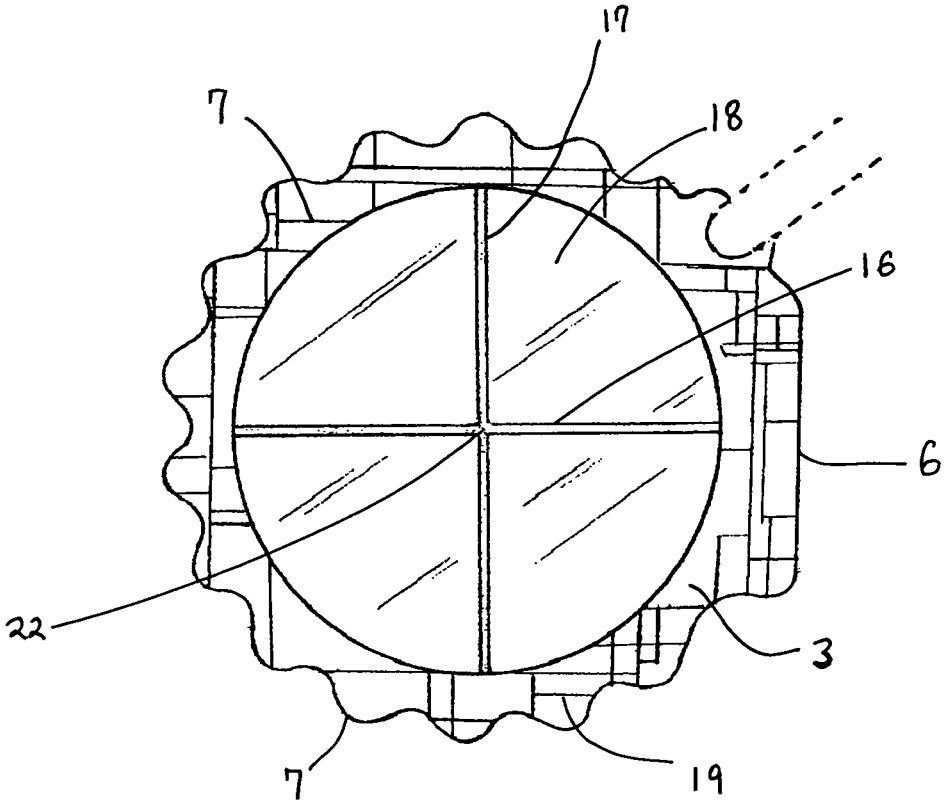
FIG. 2 is a top plan view of the inventive putter head.
Figure 3:
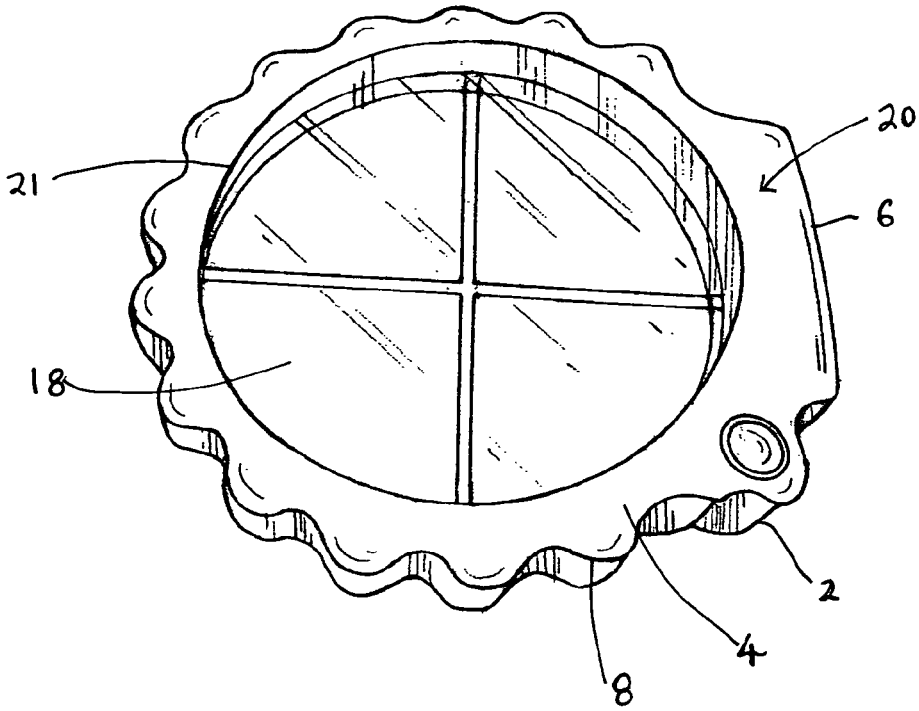
FIG. 3 is a bottom perspective view of the inventive putter head.
Figure 4:
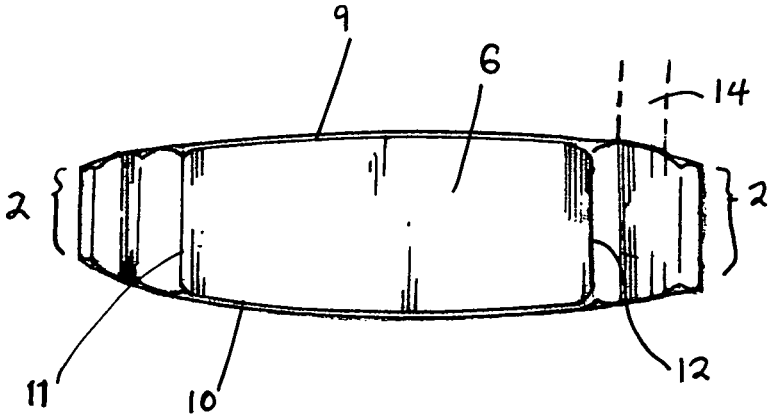
FIG. 4 is a front view of the inventive putter head.
Figure 5:
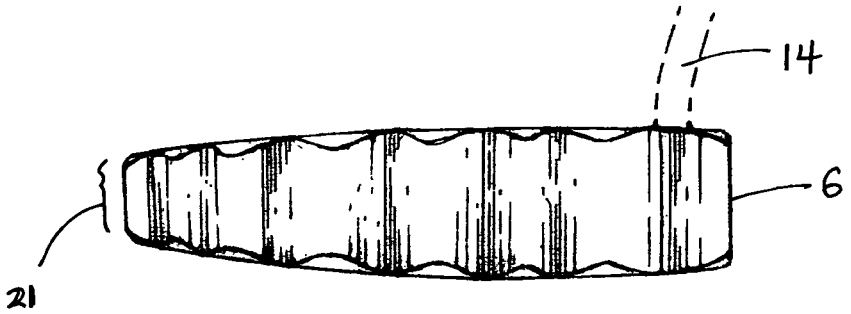
FIG. 5 is a side view of the inventive putter head.
Figure 6:
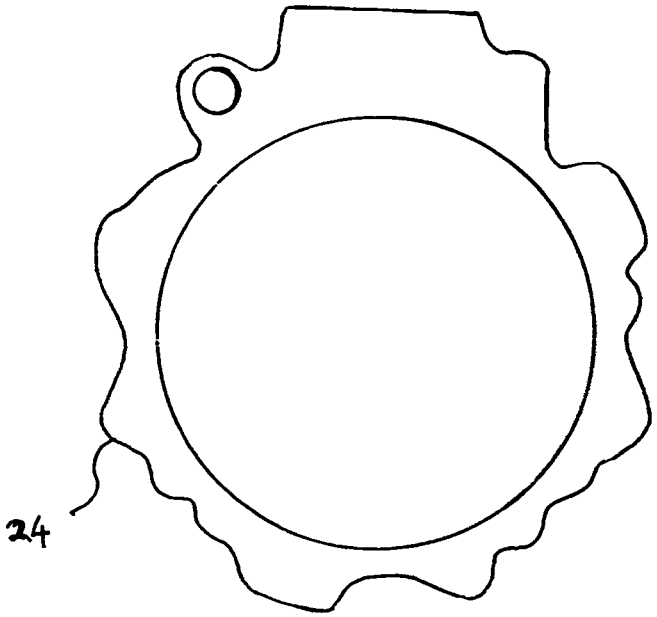
FIG. 6 is a top plan view of an alternative embodiment of the inventive putter head.

The present invention uses shape and color camouflaging pattern of the putter head to hide its shape and blend it into the green. The configuration of the alignment aid or indicia especially on a transparent background of plate 18 in synergistic combination of camouflaged surface of annular-like body 1 highlights the alignment aid against the green and further amplifies the visual impact of the alignment aid in a manner that the golfer sees only the crosshair and the golf ball. The preferred embodiments of the present invention are presented as follows:

The putter head has annular-like body 1 defined by outer substantially continuous undulating rim edge. In the preferred embodiment shown in the Figures, side rim 2 connecting and extending between outer edge 7 of top annular surface 3 and bottom outer edge 8 of bottom annular surface 4, and substantially cylindrical inner surface 5 between inner edge 23 of top surface 3 and inner edge 21 of bottom annular surface 4. The striking face region 20 at the front of the putter head has a flat or planar striking face 6 having top edge 9, bottom edge 10 and side edges 11 and 12. The undulating side rim 2 of the preferred embodiments shown in the Figures are of a sinusoidal configuration. The embodiment of FIG. 1 through 5 is of a sine wave, one having a relatively regular or constant amplitude and wave length to a point below and proximate to the area of the front striking surface and the area of the club shaft or hosel 14 as seen in FIGS. 2 and 3. Because of the regular sinusoidal appearance, the annular-like body 1 has a rounded teeth-like appearance like that of a toothed gear. The preferred embodiment of the putter head shown in the drawings, the annular-like body has curved top surface and bottom surface. The top surface 3 can be planar and further have a beveled edge. As can be seen from FIGS. 1, 4 and FIG. 5, the top and bottom edge portions of the top and bottom annular surfaces, respectively, can be further beveled from the slightly concave curved top surface 3 and opposed concave curved bottom surface 4. The annular-like body 1 can have a tapered shape or thickness as the curved top surface 3 and curved bottom surface converge from front end 6 and taper toward end 21 as is evident from front view FIG. 4 and side view of FIG. 5. It is noted the term "substantially" as used in the context of the present disclosure and the claims that follow, means small changes or deviations can be present or made without detracting from the overall feature, function and/or appearance of the element of the present invention. Top surface 3 is provided with a colored camouflage pattern 19. The pattern blends or merges the appearance of body 1 with the grass of the green. The putter head is fixed to the hosel or shaft 14 of the putter. In an alternative embodiment, the undulations can be substantially irregular as shown in FIG. 6 which shows a annular-like body that is identical to previously described annular-like body except it has an irregular sinusoidal rim edge configuration 24.

The alignment aid or indicia comprises cross hair 15 of mutually perpendicular lines: aiming line 16 that lies on or in the direction of the putter head's sweet spot and alignment line 17 that is parallel with striking face 6. The cross hair 15 is positioned on transparent plate 18. The cross hair may be simple grooves, lines of highly contrasting color (e.g., pigment or enamel) or defined by other optical effects that accents, strongly contrast and highlight the crosshair against the grass such as line(s) of highly refractive and/or reflective material such as colored or uncolored round, square or any desired shape faceted glass, lead glass or gemstone or other refractive material of sufficiently high refractive index suitable for the purpose. The refractive material can be transparent or translucent.

The undulations of the outer rim 2 of annular-like body 1 softens the profile of the putter head against the grass of the green and together with the camouflage pattern on top surface 3 renders the putter invisible against the grass of the green excepting cross hair 15, which remains highly visible. The top surface camouflage is preferably dull or matte finish. The amplitude and frequency of the undulations of outer rim 2 can optimized to obtain the greatest camouflaging effect and can be adjusted to suit the individual golfer.

The annular-like body 1 can be made of any suitable material: wood, plastic, polymer, metal, ceramic or glass. The body can have recess(es) or cavity to insert weight(s) at the appropriate location(s) to change or adjust the sweet spot and/or Moment of Inertia (MOI) of the putter head if necessary or desired. It is noted that the shape of the recess and thus the weight insert can be any desired shape such as cylindrical or rectangular recess and correspondingly shaped insert. The striking face can have a layer of material that increases the size of the sweet spot such as a polymer, which is laminated or glued onto the surface or into a square or rectangular recess in striking face 6. Polymers are known per se for their effect on putting, see for example U.S. Pat. No. 3,211,455 and U.S. Pat. No. 6,569,032. It is noted the aforementioned patents do not disclose or suggest the present invention. The area of the strike face can be reduced to a very small area surrounding the sweet spot and still putt with confidence.

The striking face 6 of the putter head can be grooved in any known manner for the purpose of putting.

Transparent plate 18 can allow the golfer to see the grass below to ascertain the condition and texture of the grass but more importantly it amplifies and highlights the crosshair to the exclusion of the visual appearance of the rest of the putter head. In the embodiment shown in Figures, the crosshair is centered at point 22 in the middle or center of circular transparent plate 18 that extends across the open annular region of the annular-like body 1. The plate may be of any desired thickness as long as it does not protrude from the bottom of the putter head and of any suitable transparent material such as plastic or glass.

It is understood that modifications and variations of the above disclosed preferred embodiments within the purview of one skilled in art are within scope of the invention.

What is claimed is:

1. A golf putter head comprising an annular body, said annular body defined by a substantially continuous annular undulating outer rim extending outwardly between an outer edge of a top annular surface and an outer edge of a bottom annular surface, said undulating rim extending continuously around the annular body terminating proximately at a striking face on a front of said annular body; an annular opening defined by an inner substantially continuous surface extending substantially vertically from an inward edge of the top surface to an inward edge of the bottom annular surface; a clear transparent plate having an alignment aid comprising means for defining a crosshair.

2. The golf putter head of claim 1, wherein said clear transparent plate is circular.

3. The golf putter head of claim 1, wherein said top surface is provided with a camouflage pattern.

4. The golf putter head of claim 3, wherein said undulating rim comprises a regular sinusoidal rim.

5. The golf putter head of claim 1, wherein said undulating rim comprises a sinusoidal rim.

6. The golf putter head of claim 1, wherein said undulating rim comprises an irregular sinusoidal rim.

7. The golf putter head of claim 1, wherein said means for defining a crosshair comprises an intersecting pair of grooves.

8. The golf putter head of claim 1, wherein said means for defining a crosshair comprises intersecting lines of highly contrasting color.

9. The golf putter head of claim 1, wherein said means for defining crosshair comprises intersecting lines of high refractive or reflective material.

10. The golf putter head of claim 9, wherein said high refractive material is selected from the group consisting of glass, lead glass, gemstones and mixtures thereof.

11. The golf putter head of claim 1, wherein said bottom annular surface is curved.

12. The golf putter head of claim 1, wherein said top annular surface is curved.

13. The golf putter head of claim 1, wherein said top annular surface extends from said striking face and curves downward from an area toward said bottom annular surface, said bottom annular surface curves upwardly toward said top annular surface and convergingly toward a distal end of said golf putter head away from and opposite to said striking face.

14. The golf putter head of claim 1, wherein said outer edge of bottom annular surface is beveled.

15. The golf putter head of claim 1, wherein said outer edge of top surface is beveled.

16. The golf putter head of claim 1, wherein said clear transparent plate has a center point, said crosshair has an intersecting point and said intersecting point is positioned substantially in the center point of said clear transparent plate.

17. A golf putter head comprising an annular body, said annular body defined by a substantially continuous annular undulating outer rim extending outwardly between a top annular surface and a bottom annular surface, said top annular surface provided with a camouflage pattern, said undulating rim extending continuously around the annular body terminating proximately at a striking face on said annular body; an annular opening defined by an inner substantially continuous surface extending substantially vertically from an inward edge of the top surface to an inward edge of the bottom annular surface; a substantially circular clear transparent plate having an alignment aid comprising means for defining a crosshair.

* * * * *